United States Patent [19]

Rotondo et al.

[11] Patent Number: 4,504,428

[45] Date of Patent: Mar. 12, 1985

[54] METHOD FOR MAKING REINFORCED CONCRETE PRODUCTS

[76] Inventors: Philip L. Rotondo, 8 Watson Dr., Simsbury, Conn. 06070; Thomas J. Rotondo, 173 Old Farms Rd., Avon, Conn. 06001

[21] Appl. No.: 481,931

[22] Filed: Apr. 4, 1983

Related U.S. Application Data

[62] Division of Ser. No. 111,168, Jan. 10, 1980, Pat. No. 4,404,786.

[51] Int. Cl.[3] ..... E04B.1/16

[52] U.S. Cl. ..... 264/34; 83/200; 83/580; 140/140; 264/35; 264/152; 264/172; 264/173; 264/174; 264/256; 264/279.1; 264/311

[58] Field of Search ..... 83/199, 200, 580; 140/140; 264/34, 35, 172, 173, 174, 256, 279.1, 310, 311, 312, 152, 157; 425/62, 64, 110, 126 R, 142, 145, 289, 375, 453, 457, 460, 435

[56] References Cited

U.S. PATENT DOCUMENTS

| | | | |
|---|---|---|---|
| Re. 25,587 | 6/1964 | Wiltshire | 425/435 |
| 804,321 | 11/1905 | Hoxie | 83/199 |
| 890,373 | 6/1908 | Orr | 52/40 |
| 1,500,414 | 7/1924 | Moir . | |
| 1,951,841 | 3/1934 | Roberts | 83/200 |
| 2,671,260 | 3/1954 | Jessen et al. | 264/311 |
| 2,677,955 | 5/1954 | Constantinesco | 52/659 X |
| 2,729,028 | 1/1956 | Slayter et al. | 425/289 |
| 2,870,793 | 1/1959 | Bailey | 52/40 X |
| 2,949,655 | 8/1960 | Berumen . | |
| 3,104,579 | 9/1963 | Blankenship et al. | 83/580 |
| 3,429,094 | 2/1969 | Romualdi . | |
| 3,501,920 | 3/1970 | Uchiyama . | |
| 3,602,410 | 8/1971 | Dennis . | |
| 3,650,785 | 3/1972 | Bail . | |
| 3,808,924 | 5/1974 | Ferguson | 83/199 |
| 3,852,930 | 12/1974 | Naaman | 52/659 X |
| 4,062,913 | 12/1977 | Miller et al. | 52/659 |
| 4,066,723 | 1/1978 | King et al. | 264/34 |

FOREIGN PATENT DOCUMENTS

| | | | |
|---|---|---|---|
| 2068288 | 8/1981 | United Kingdom | 264/256 |

OTHER PUBLICATIONS

"Fiber Reinforced Concrete", American Concrete Institute, Publication SP-44, 1973.

*Primary Examiner*—Jay H. Woo
*Assistant Examiner*—James C. Housel
*Attorney, Agent, or Firm*—Joseph R. Spalla

[57] ABSTRACT

A method for making reinforced concrete including the steps of laying down layers of concrete and contemporaneously automatically cutting, and bodily ejecting into the contemporaneously layed down layers of concrete oriented wire lengths in any desired aligned patterns. In one embodiment the concrete layers are injected into a rotating cylindrical form and the oriented wires are cyclically bodily thrown off at selected angular intervals for embedment in axially aligned annular arrays in the concrete layers.

6 Claims, 14 Drawing Figures

METHOD FOR MAKING REINFORCED CONCRETE PRODUCTS

This application is a division of application Ser. No. 111,168, filed Jan. 10, 1980, now U.S. Pat. No. 4,404,786 issued Sept. 20, 1983.

This invention relates to a method for making reinforced concrete products; more particularly, it relates to methods and apparatus wherein reinforcing rods are automatically introduced during the introduction of concrete into a form; and specifically, to a method in which reinforcing wire rod from reels is automatically fed, cut, and ejected into concrete contemporaneously introduced into a mold.

The making of reinforced concrete products usually involves, as a first step, the laborious construction of wire work in a mold or form, after which concrete is poured and allowed to set and cure. The dispersal of wire reinforcing, if high tensile strengths are to be achieved, must be ordered; and it is not feasible or economically practical to arrange and order steel work in forms for making particular products to achieve high tensile strengths as, for example, in the manufacture of centrifugally precast reinforced concrete poles.

In accordance with the invention, there is provided a novel method which permits, automatically, the placement of wire rods in ordered patterns contemporaneously with the pouring of concrete into a form thereby eliminating tedious and expensive manual labor and making practical and economical the manufacture of reinforced concrete products of special forms, e.g. utility poles.

A feature of the invention resides in a novel wire rod cutting and ejecting mechanism which is bodily movable relative to a form. In a specific embodiment for making centrifugally precast reinforced poles, the ejection mechanism also includes means to convey concrete to a rapidly rotating or spinning form whereby centrifugal forces cause concrete to move to the outer periphery of the form, and as each layer of concrete is so formed individual cut wire rods are ejected and imbedded in a desired ordered pattern and amount. Such a pole product is made in successive layers by moving the ejection mechanism and rotating forms relative to one another through successive cycles.

An object of the invention is to provide a method for automatically manufacturing reinforced concrete products.

Another object of the invention is to provide a high tensile strength low cost precast utility pole competitive with wood utility poles.

Another object of the invention is in the provision of a method for automatically manufacturing reinforced concrete products wherein reinforcing wire rods or filaments are automatically injected contemporaneously with the concrete pouring process.

Another object of the invention is to provide a method for automatically cutting and ejecting into concrete wire lengths in any desired pattern.

Still another object is to provide a method for making centrifugally precast reinforced concrete poles in which concrete and steel work are contemporaneously introduced in a rotating form.

A further object of the invention is in the provision of methods and apparatus for contemporaneously pouring layers of concrete and arrays of reinforcing rod or filament to form continuous ribbons of reinforced concrete.

Other objects of the invention will become apparent to those skilled in the art from a reading of the following detailed description of preferred embodiments when taken in conjunction with the accompanying drawing in which like reference numerals designate like or corresponding parts, wherein:

IN THE DRAWING

Figure 1:
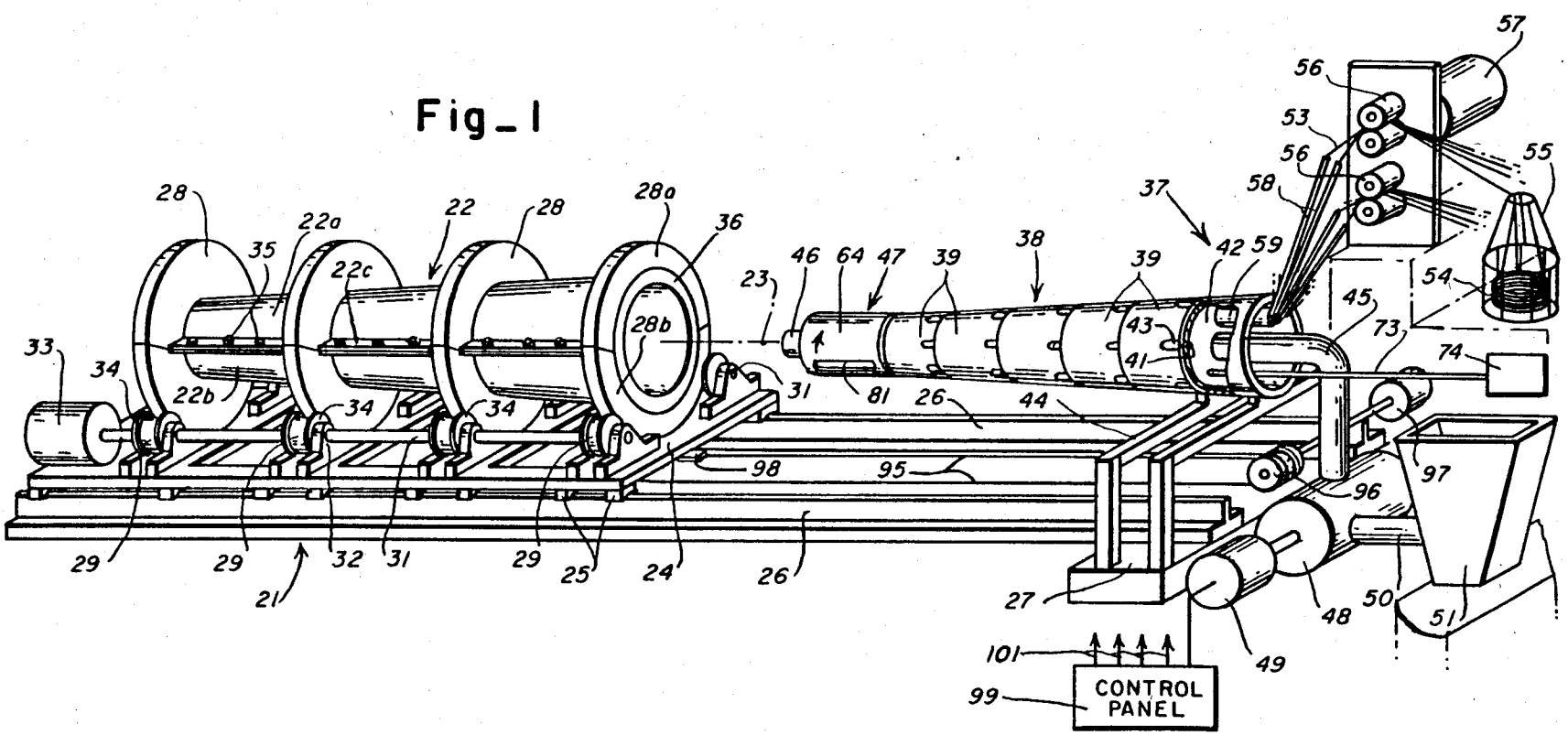
FIG. 1 is a perspective view showing apparatus for making precast tubular reinforced concrete utility poles in accordance with the invention.

Referring now to the drawing wherein like reference numerals designate like or corresponding elements throughout the Figures, there is shown in FIG. 1 an apparatus for making hollow tubular concrete poles with included individual and ordered reinforcing wires and randomly placed wires to inhibit spalling and cracking.

The apparatus comprises a mold spinning assembly generally designated by reference numeral 21 supporting a hollow tubular mold 22 shown tapered to form a hollow tapered utility pole of conventional dimensions. Current pole sizes presently being used by pole manufacturers are generally 40 feet in length with the top end having an outer diameter of 8.25 inches and increasing toward the lower end at the rate of 0.145, 0.165 or 0.180 inches per foot of length.

The mold 22 is supported for rotation about its axis 23 on a carriage 24 which in turn is supported for to and fro movement in the direction of the axis 23 of the tubular mold 22 as by carriage mounted linear bearings 25 supported on guide tracks 26 secured to a reference plane 27.

Rings 28 of uniform outer diameter are welded to the tubular mold and axially spaced along its outer periphery. The rings 28 support the mold 22 on driving rolls 29 secured to spaced shafts 31 rotatably supported on upstanding supports 32 of the carriage 24. One of shafts 31 is coupled to a motor 33 whereby the driving rolls 29 will frictionally drive the rings 28 and the mold 22. One or more of the driving rolls 29 has flanges 34 which embrace the rings 28 to preclude axial movement of the mold 22 relative to the carriage 24.

The tubular mold 22 shown in FIG. 1 is made of steel or other material which does not adhere to concrete and, in the disclosed embodiment, comprises two semicircular tapered shells 22*a* and 22*b* having externally extending radial flanges 22*c*, which are releasably secured together as by bolts 35 or equivalent fastening to allow disassembly for removal and curing of a formed hollow pole. As shown in FIG. 1, the friction rings 28 comprise semi-cylindrical sections 28*a* and 28*b* which come together at the joining line of the flanges 22*c*. While a tubular mold 22 which can be disassembled is described, it is to be understood that a unitary tubular mold 22 from which a formed pole can be axially removed is within the scope of the invention.

As viewed in FIG. 1, the wide or rightmost end of the tubular mold 22 has an end plate 36 of annular form whose inner diameter is equivalent to the internal diameter of the wide end of a formed pole. The other end of the tubular mold 22 has a similar annular end plate (not shown) whose inner diameter is equal to the inner diameter of the narrow end of the pole to be formed.

Positioned opposite or to the right of the wider end of the tubular tapered mold 22 is a concrete and wire placement mechanism generally designated by reference numeral 37. The concrete and wire placement mechanism 37 comprises an elongated hollow generally tapered support tube 38 comprising a plurality of axially aligned cylindrical sections 39 of decreasing diameter which are secured together as by bolts 41 extending axially through adjacent end bulkheads 42 of the sections. Access to the bolts 41 is by way of slots 43. The rightmost section 39, as viewed in FIG. 1, of the elongated tapered support tube 38 is rigidly mounted on and secured to a raised platform 44 which is in turn rigidly secured to the reference or base plane 27.

A cylindrical concrete conveying steel tube 45 extends through the elongated support tube 38 and is supported generally coaxially of the support tube 38 by the bulkheads 42 in the sections 39. The leftmost or discharge end 46 of the concrete conveying tube 45 extends beyond the support tube 38 and rotatably supports about its outer periphery a driven wire cutting and ejecting mechanism generally designated by reference numeral 47.

The tapered support tube 38 and the wire cutting and ejecting mechanism 47 extend horizontally along a line coextensive with the axis 23 of the tubular mold 22 and have a free length at least equal to the length of the tubular mold 22 whereby relative axial movement of the tubular mold 22 and placement mechanism 37 will permit insertion of the latter to the narrow end of the tubular mold 22. The rightmost end of the concrete conveying tube 45 is connected to a motor driven concrete slurry pump 48 driven by a motor 49 which pumps concrete from a hose 50 connected to a concrete supply hopper 51 of mixed concrete to the rightmost or inlet end of the concrete conveying tube 45 and moves it therethrough to the outlet or discharge end 46 of the concrete conveying tube 45.

As shown in FIG. 1, a plurality of wires 53 are axially drawn from wire coils 54 supported in conventional payout baskets 55 (only one of which is shown) by friction feed rolls 56 driven by a common motor 57.

Figure 3:
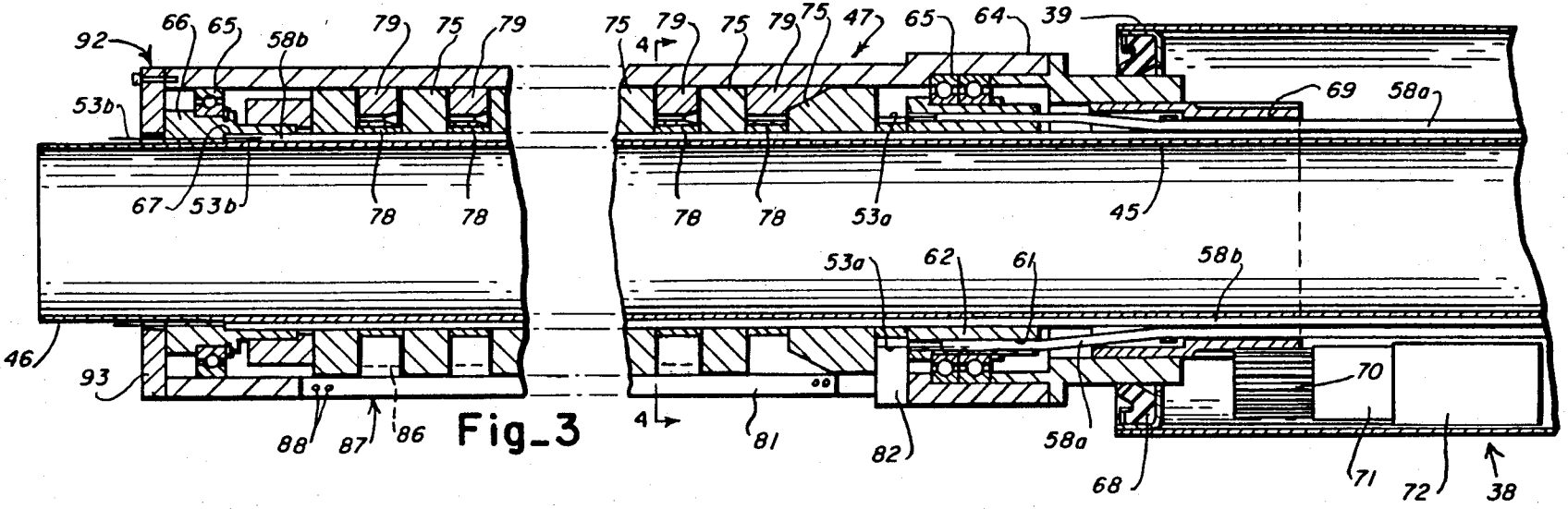
FIG. 3 is a vertical cross-sectional view of the wire cutting and ejection mechanism of FIG. 1 at a particular angular orientation.
Figure 6:
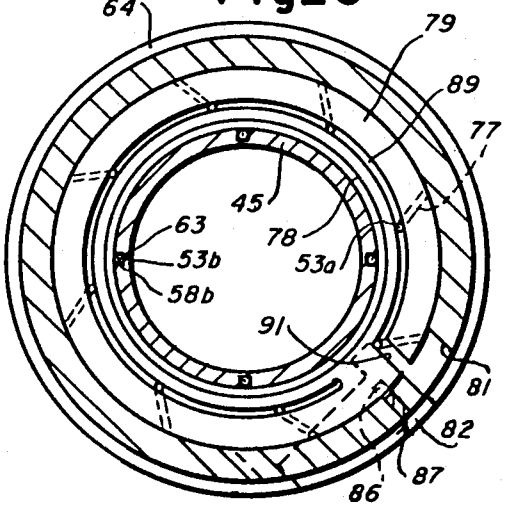
FIGS. 4, 5 and 6 are cross-sectional views taken along lines 4—4 of FIG. 3 at different angular rotations illustrating wire cutting, ejection, and insertion.

The drawn off wires 53 are driven by associated friction drive rolls 56 through individual wire guide tubes 58 which convey the wires 53 to the wire cutting and ejecting mechanism 47. The wire guide tubes 58 are themselves directed through a common tube 59 which extends internally of the support tube 38 to the terminal section 39 preceding the wire cutting and ejection mechanism 47. In the terminal section 39 as shown in FIG. 3 certain ones 58*a* of the wire guide tubes 58 extend partway into openings 61 angularly disposed in an entry die block 62 of the wire cutting and ejecting mechanism 47. Others 58*b* of the guide tubes 58 extend through axially extending grooves 63 (FIGS. 4–6) in the outer periphery of the concrete conveying tube 45 for reasons hereinafter evident.

With particular reference to FIG. 3, the wire cutting and ejection mechanism 47 comprises a cylindrical power tube assembly 64 coaxially disposed externally of and spaced from the concrete conveying tube 45 and supported for rotation about the latter by spaced bearings 65 (FIG. 3). The rightmost bearing 65 is mounted about the entry die block ring 62 and the leftmost bearing 65 about an exit or second die block ring 66 (FIG. 3) which has openings 67 into which the guide tubes 58*b* located in grooves 63 of the concrete conveying tube 45 extend partway. Both die block rings 62 and 66 are oriented and secured as by keys (not shown) to the concrete conveying tube 45.

The power tube 64, at its rightmost end, extends into terminal section 39 through a sealing ring 68 and has a cylindrical gear 69 which is in meshing engagement with a gear 70 secured to the end of a shaft 71 (FIG. 3) located between the concrete conveying tube 45 and the support tube 38 and secured to the latter. The shaft 71 is driven by a conventional commercially available hydraulic motor 72 located in and secured to the terminal section 39 of the support tube 38. The motor 73 is driven by hydraulic fluid conveyed by lines 73 (FIG. 1) connected to a motor driven hydraulic pump system with control valves and generally designated by reference numeral 74.

Figure 2:
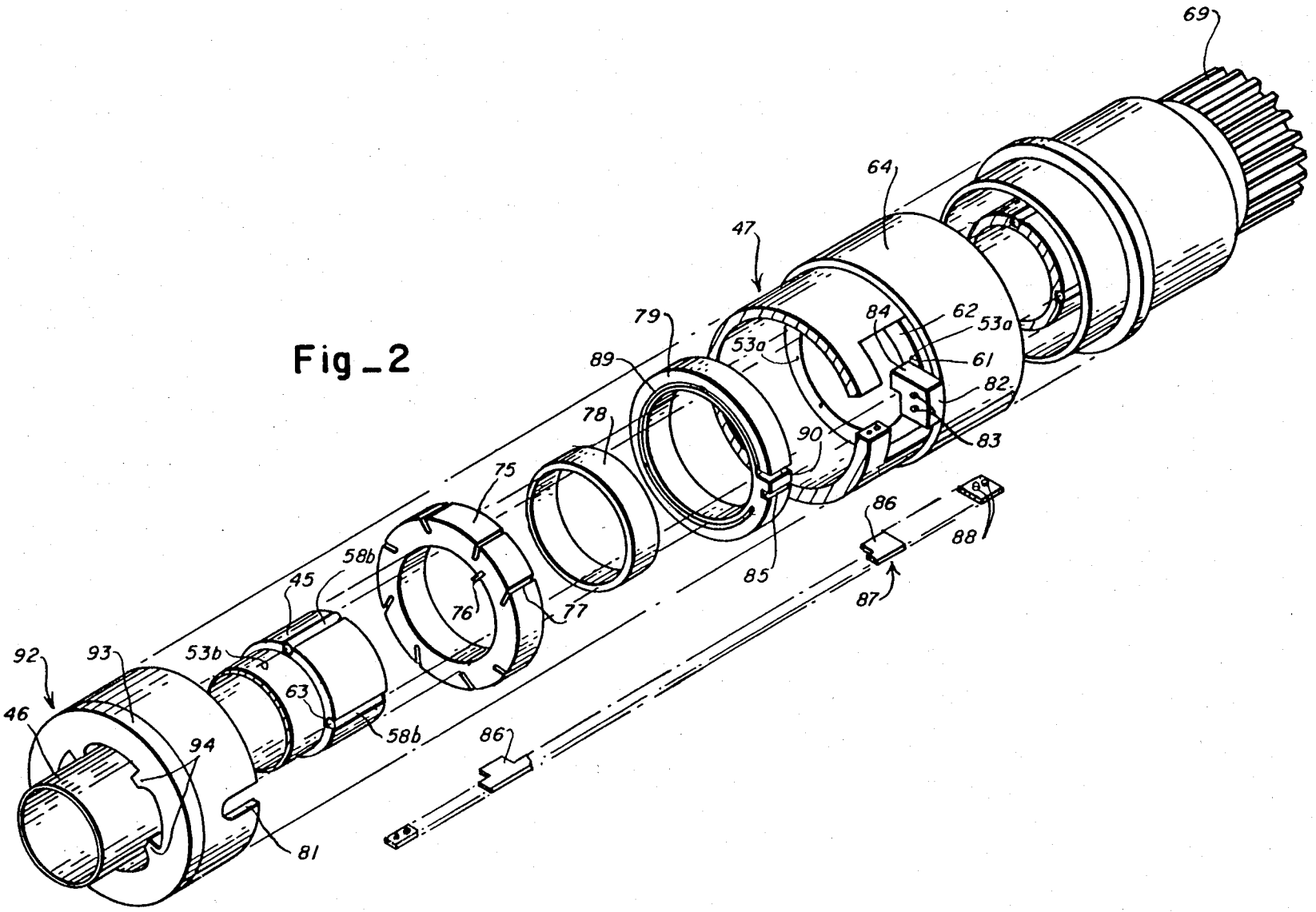
FIG. 2 is an exploded perspective view illustrating details of elements comprising the wire cutting and ejecting mechanism.

As seen in FIGS. 2 and 3, the concrete conveying tube 45, to the left of the entry die block ring 62, supports along its exterior length and within power tube 64 a plurality of fixed or stationary rings 75 which, except for the rightmost ring 75, are of identical shape. The stationary rings 75 are fixed to the concrete conveying tube 45 as by keys 76. As best seen in FIG. 2 and FIGS. 4–6, the stationary rings 75 are provided with a plurality of angularly spaced slots 77 corresponding to the number of wires 53*a* entering the die block 62 at angularly spaced positions. Each of the slots 77 extends along a chord line to the periphery of the stationary rings 75 forming an acute angle with a radius line to the root of the slots 77.

As shown in FIGS. 2 and 3, the concrete conveying tube 45 also supports spacer rings 78 between the stationary rings 75 which rotatably support rotatable rings 79 between the stationary rings 75.

With particular reference to FIGS. 1 through 3, the power tube 64 is provided with an axially extending wire exit slot 81 which, at its rightmost end adjacent the entry die block 62, extends circumferentially counterclockwise to accommodate a wire cutter 82 secured as by bolts 83 to a shoulder on the power tube 64. The wire cutter 82 extends radially inwardly beyond the wire exit openings 61 in the die block 62 and its cutting edge 84 is located midway of the exit slot 81.

Referring again to FIGS. 2 and 3, the rotatable rings 79 are provided with external radial drive grooves 85 for the reception of drive teeth or lugs 86 which extend from a toothed bar 87 which is secured as by bolts 88 to a radial edge of the wire exit slot 81 in the power tube 64.

Each of the rotatable rings 79 is formed with an annular groove 89 (FIG. 2) which is axially aligned with the root of the slots 77 in the stationary rings 75. The annular groove 89 extends from adjacent but radially inwardly of the drive groove 85 almost 360° and terminates in a substantially radially extending camming groove or slot 90 open to the periphery of the rotatable rings 79 opposite the wire exit slot 81 in the power tube 64. The entry side of the annular grooves 89 of the rotatable rings 79 are bevelled to guide the wires 53*a* therethrough.

As will be appreciated from the above description of the wire cutting and ejection mechanism 47, the driven power tube 64 which carries the toothed bar 87 will rotate the rotatable rings 79 about the concrete conveying tube 45 and, as the annular grooves 89 in the rotatable rings 79 extend over almost 360°, driven wires 53*a* passing through the die block ring 62 will pass through the axially aligned inner ends or roots of the radial slots 77 in the stationary rings 75 and through the annular grooves 89 in the alternately disposed rotatable rings 79 at substantially all angular orientations of the rotatable rings 79. As entering wires 53*a* are frictionally fed, they will await rotation of the rotatable rings past the small angle through which the groove 89 does not extend.

Figure 5:
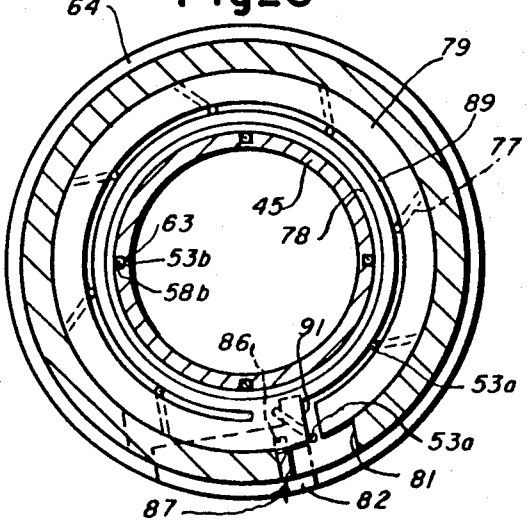
Figure 4:
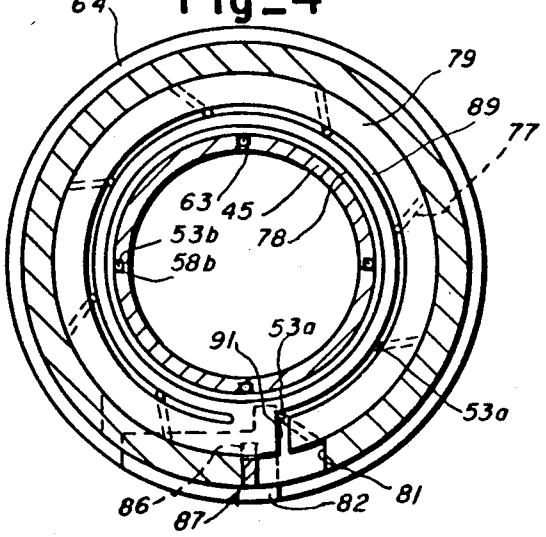

With reference to FIG. 4, the wire cutter 82 on the power tube 64 is shown moving counterclockwise past the six o'clock position where it will encounter and sever a wire 53*a* at that angular position extending into the wire cutter and ejecting mechanism 47. Continued rotation of the power tube 64 and the rotatable rings 79, as shown in FIG. 5, will cause the edges 91 of all of the radial camming grooves 90 in the rotatable rings 79 to simultaneously encounter the severed wire 53*a* and collectively cam the severed wire 53*a* out of the radial slots 77 in the stationary fixed rings 75. This camming action will throw off a severed wire 53*a* through the wire exit slot 81 of the power tube 64. Continued rotation will cause the next wire 53*a* at substantially the four o'clock position to be severed and thrown off, etc.

As the wires 53*a* are severed, additional lengths of wire 53*a* are fed into the wire cutting and ejecting mechanism 47 and reach through to the last or leftmost stationary ring 75 which is not provided with slots 77, whereby it acts as a limiting stop, before the cutter 82 again reaches the cut off position in the next revolution of the power tube 64.

With reference again to FIGS. 2 and 3, the leftmost end of the power tube 64 has secured thereto, adjacent the second die block ring 66, a second wire cutter 92 comprising a disc 93 having cutting lugs 94 which is secured to the power tube 64 and which, as the power tube 64 rotates, severs short lengths of wire 53*b* conveyed through wire guide tubes 58*b* extending partway into the second die block ring 66. The severed lengths 53*b* are randomly thrown off. As shown, the concrete conveying tube 45 is of reduced diameter toward its leftmost end to accommodate the second die block 66 so as to allow entry of wire guide tubes 58*b* partway into the openings 67 of the second die block 66. The lengths of wire 53*b* severed by the second cutter lugs 94 are thrown off in random fashion as contrasted to the ordered fashion of wires 53*a* radially thrown off through exit slot 81. The lengths of wire 53*b* are randomly thrown off only after the laying down of the initial layer of concrete to prevent spalling and cracking of the outer layer of a formed pole; accordingly, the feed of wires 53*b* will be such that wires 53*b* will be fed only during formation of the outer layers of a pole.

Referring again to FIG. 1, relative axial motion of the tubular mold 22 and the concrete and wire placement mechanism 37 may be accomplished by a cable 95 wound about a drum 96 driven by a reversible motor 97. One end of the cable 95 is connected to the carriage 24 as at 98 to pull the carriage 24 to the right as viewed in FIG. 1 and the other end of the cable 95, after looping around a pulley (not shown), anchored to the reference plane 27, is connected to the carriage 24 to pull it to the left, according to the direction of motor rotation.

To prepare the machine for operation, an operator will set in or program from a control panel 99 the mold spin speed, the speed of relative axial movement of the mold 22, the number of insertion and retraction cycles, the rate of concrete flow, the wire feed rate, and the rotational speed of the power tube 64, to which the wire feed rate will be synchronized, according to the amount and pattern of wire to be placed in a pole cycle.

The mold spin speed should be at least great enough to centrifugally force concrete flowing out the end 46 of the concrete conveying tube 45 to the inner wall of the mold 22 and be held thereagainst.

After setting in the necessary parameters and pushing a start button on the control panel, signals will be carried on lines 101 to the various motors whereby concrete and wire will be placed in the mold 22 during each insertion or retraction thereby building up multiple layers of concrete and radially thrown off wire 53*a*.

Figure 7:
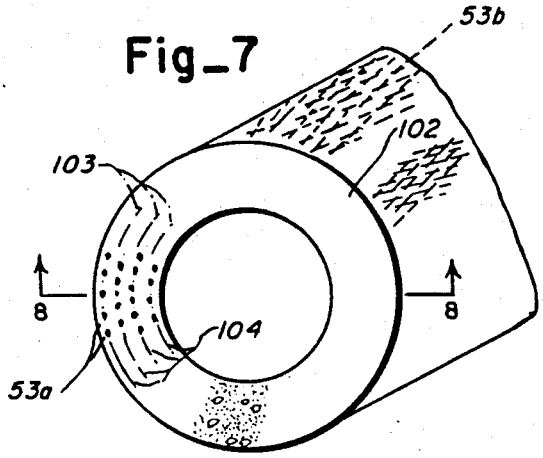
FIG. 7 is a cross-sectional view of a pole formed with apparatus of FIG. 1 illustrating the construction thereof.

FIG. 7 shows a cross-section of a pole 102 having layers 103 of concrete, annular arrays 104 of wire 53*a* and random wires 53*b* in the outer layer 103 formed incident to insertion and retraction of the concrete and wire placement mechanism 37. When the necessary layers to form a pole have been deposited, the mold is rotated for an additional length of time to consolidate the concrete and the formation of a pole. Following formation of such a pole product, the mold 22 is removed from the carriage 24 and set aside until such time as the pole 102 can be removed for subsequent curing.

Figure 8:
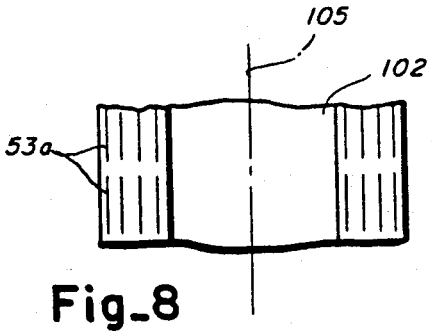
FIG. 8 is a longitudinal cross-sectional view taken along lines 8—8 of FIG. 7 illustrating a wire pattern.

With reference to FIGS. 7 and 8, showing horizontal and axial cross-sections of a formed pole, the wires 53*a* are seen substantially aligned with the axis 105 of the pole 102 and that in the finally formed pole the arrays 104 of wires 53*a*, due to centrifugal action, tend to work their way outwardly and are more closely or densly spaced toward the outer periphery of the pole 102. Further, though not shown, varying amounts of wire 53*a* may be provided along different sections or lengths of a pole 102.

Figure 9:
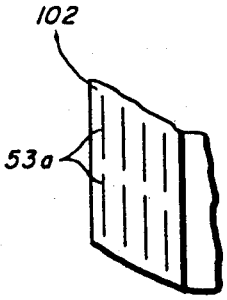
FIGS. 9 and 10 are views similar to FIG. 8 showing other patterns.
Figure 10:
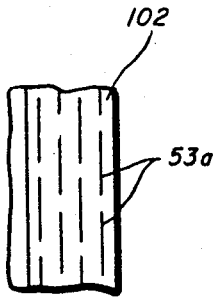

FIGS. 9 and 10 show axial sections of a pole 102 formed with wires 53*a* placed in different patterns.

Figure 11:
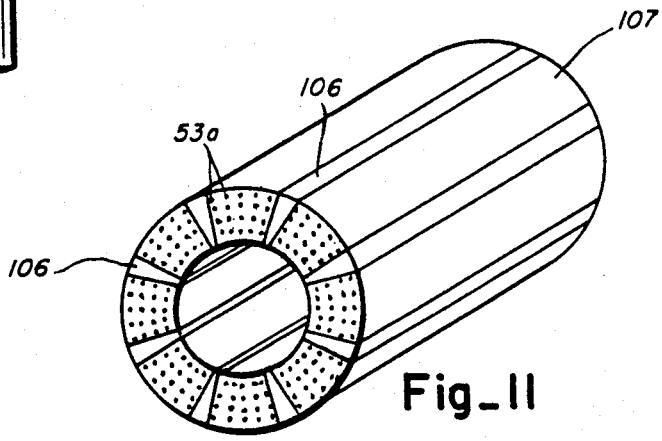
FIG. 11 is a perspective view of a segmented hollow structure formed with apparatus of FIG. 1 with a modified mold.

FIG. 11 illustrates a product which can be made as described above but with axial wedge-shaped spacers 106 in the mold 22 to produce a plurality of segments 107, each of which may be used, e.g., as reinforced concrete railroad ties.

Wood utility pole classifications are based on dimensions and grade and are not performance related. However, the approximate performance of Class 4 wood poles taken from the appendix of the *American National Standards, Specifications and Dimensions for Wood Poles* (ANSI 05.2-2973), states that Class 4 poles must withstand an ultimate load of 2,400 lbs. applied 2 feet from the top to provide a safety factor of 4.

Poles 102, in accordance with the invention, exceeded this design criteria in that first crack did not occur until loads in excess on the order of 2.5 times the design working load were applied as determined with a hydraulically operated Forney machine.

These results were achieved employing concrete having a cement content of from 10–12 94# bags per cubic yard.

Poles 102 with a ratio of moduli of rupture to first crack strength on the order of 1.6, were consistently produced with wire volumes of from ¾–4%. Moduli of rupture on the order of 8,000 psi and first crack of 5,000 psi were obtained with 2% wire volumes. Steel wire, e.g., 1008, 1040, 1060, 1080, having progressively higher carbon content and tensile strength from 80,000–360,000 psi, were used with wire diameters of from 0.030–0.050 inches. Smaller diameter wire improved moduli of rupture. To promote a good bonding and to increase the moduli of rupture, it was discovered that purchased wire should be stripped clean of drawing lubricants and allowed to oxidize slightly or, in the alternative, be etched before use.

Also in accordance with the invention, lengths of wire 53*a* of at least 10 inches and above were found necessary to achieve consistently high ratios of moduli of rupture to crack strength and particularly to provide crack arrest. Lengths of wire 53*a* of 18–22 inches were found adequate to meet design objectives with longer wires 53*a* giving only marginal improvement. Thus, wire L/D ratios of at least on the order of 360 and higher are believed necessary with the wire 53*a* uniformly distributed to provide a high strength pole.

Figure 12:
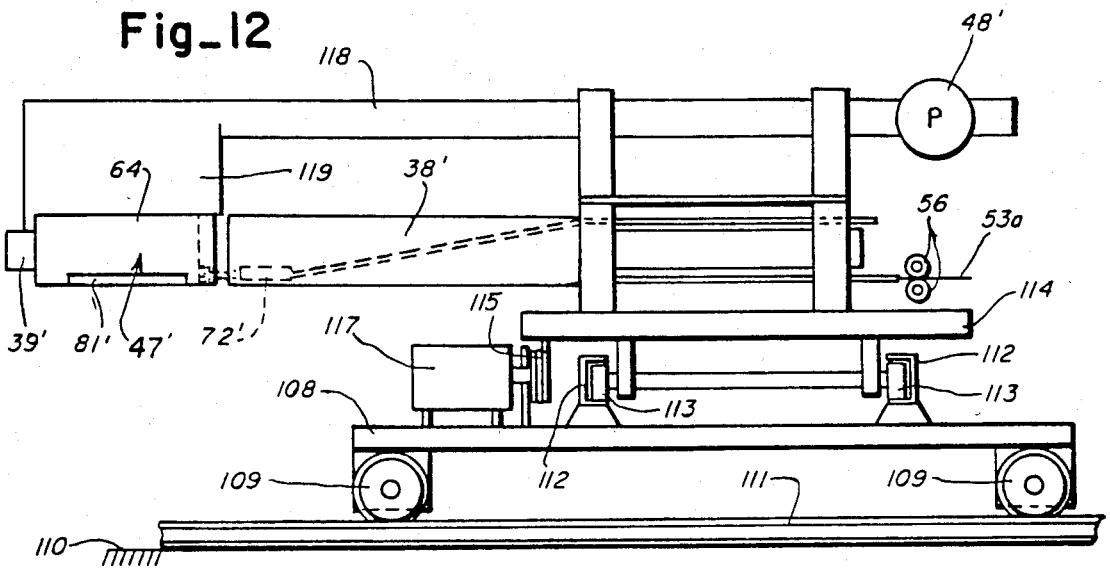
FIG. 12 is an elevational view showing apparatus for laying reinforced concrete ribbons in accordance with the invention.
Figure 13:
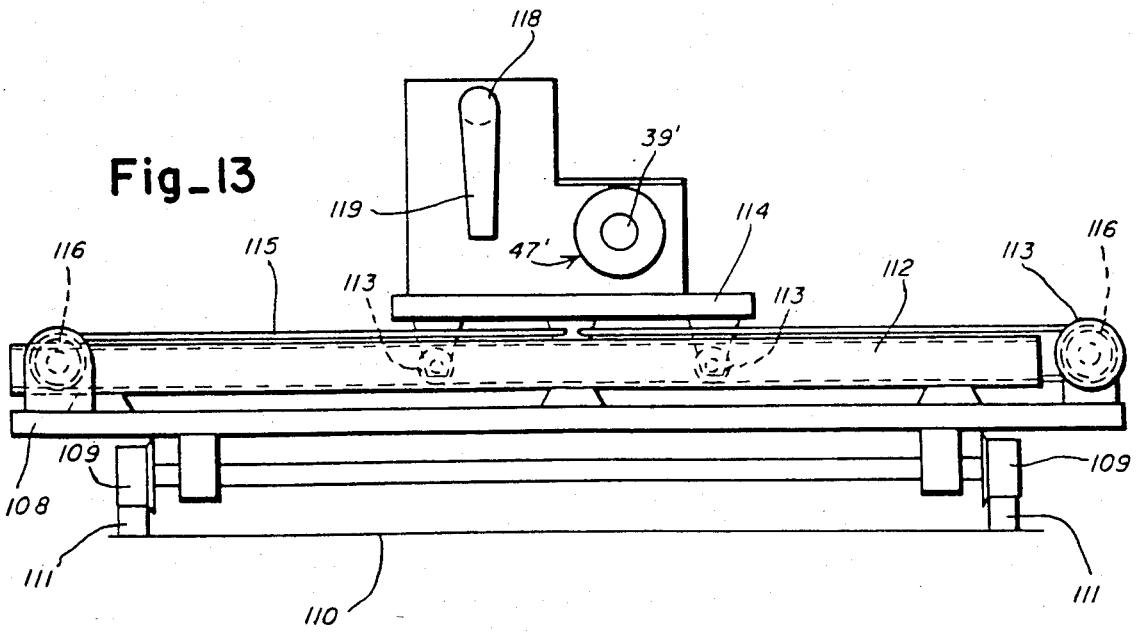
FIG. 13 is a front elevational view of the apparatus of FIG. 12.

Referring now to FIGS. 12 and 13, wherein prime numbers are employed to designate the same or similar apparatus, there is shown an apparatus for laying ribbons of reinforced concrete to form walkways or roads. The apparatus is supported on a platform 108 having wheels 109 whereby it may be moved longitudinally along a roadbed 110 or on forms 111 defining the edges of a prepared bed into which concrete is to be laid. Platform 108 may be part of or drawn by a vehicle (not shown). On the platform 108 are spaced transverse tracks 112 guiding wheels 113 supporting a second platform 114. The second platform 114 is coupled to be driven in a traverse direction by a traverse chain 115 secured to the second platform 114 and guided about pulleys 116, at the ends of the first platform 108, one of which is driven by a motor 117.

The second or traversing platform 114 supports a concrete conveying tube 118 which terminates in a downwardly directed nozzle 119. As in FIG. 1, a pump 48', connected by tubing to a concrete supply (not shown), will cause concrete to be moved through tube 118 for discharge on the bed 110. Below and traversely offset from the concrete nozzle 119, there is supported a wire cutting and ejecting mechanism 47' similar to that described in FIGS. 1–6 but only provided with wires 53*a* located for insertion at or close to the six o'clock position whereby wire 53*a* will only be thrown off through the slot 81' downwardly in concrete laid down by nozzle 119 rather than at all angles of rotation. The wire ejecting mechanism 47' will be rotated by a hydraulic drive motor 71' whereby wire 53*a* will be ejected in concrete laid down by nozzle 119.

Figure 14:
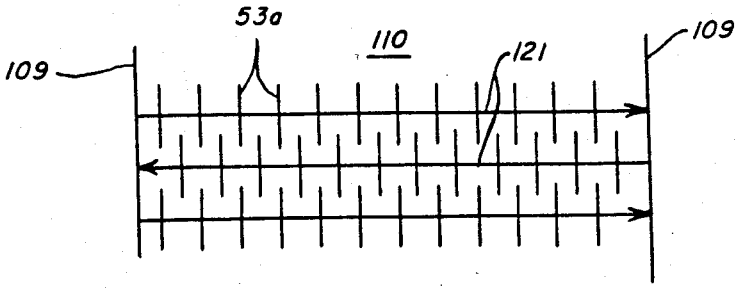
FIG. 14 is a view illustrating operation of the apparatus of FIG. 12.

In operation, at each longitudinal increment of the longitudinal platform 108 along the roadway, the traverse platform 114 will make several traverses 121 depositing layers of concrete and wire 53*a*, as shown in FIG. 14, with the total thickness made up by controlling the number of traverses per rate of longitudinal advance.

The invention claimed is:

1. A method of producing reinforced concrete structures comprising the steps of serially introducing layers of concrete in a form, cyclically feeding, cutting and forcibly bodily throwing off, at spaced intervals, straight axially oriented cut lengths of reinforcing wire at least 10 inches in length into each layer whereby said wires are imbedded in parallel ordered arrays, and curing said layered structure.

2. A method of producing hollow reinforced concrete poles comprising the steps of rotating an elongated hollow cylindrical form of predetermined length, axially moving said form relative to means for introducing concrete into said form whereby centrifugal force holds said concrete in layers within said form, cyclically bodily throwing off at angularly spaced intervals axially oriented cut lengths of wire into the concrete layers, whereby said wires are axially embedded in axially aligned annular arrays along the length of said form, and curing said concrete and embedded wire to produce said poles.

3. The method as recited in claim 2 including the step varying the rotational speed of said form to vary said wire pattern.

4. The method as recited in claim 2 including the step of varying the axial speed of said form.

5. The method as recited in claim 2 including the step of varying the cyclic speed of wire throw off.

6. A process for making a hollow reinforced concrete pole comprising the steps of rotating an elongated hollow tapered cylindrical form of predetermined length, axially cyclically moving said form to and fro, introducing concrete into the interior of said rotating form during axial movement thereof whereby layers of concrete are laid down along the length of said form and held against the interior of said form by centrifugal force, cyclically bodily throwing off at angularly spaced intervals axially oriented straight cut lengths of wire at least 10 inches in length into said spinning and axially moving form for axial embedment in said concrete layers in axially ordered annular arrays along the length of said form, and curing said concrete and embedded wire.

* * * * *